US010343124B2

(12) United States Patent
Irani et al.

(10) Patent No.: US 10,343,124 B2
(45) Date of Patent: Jul. 9, 2019

(54) COATED MIXING DEVICE FOR HYDROCARBON FLUID STORAGE CONTAINERS TO COMBAT MIXING ABRASION

(71) Applicant: Halliburton Energy Services, Inc., Houston, TX (US)

(72) Inventors: Cyrus Irani, Houston, TX (US); Scott Miller, Highland Village, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 349 days.

(21) Appl. No.: 15/102,617

(22) PCT Filed: Mar. 25, 2014

(86) PCT No.: PCT/US2014/031703
§ 371 (c)(1),
(2) Date: Jun. 8, 2016

(87) PCT Pub. No.: WO2015/130324
PCT Pub. Date: Sep. 3, 2015

(65) Prior Publication Data

US 2016/0354738 A1 Dec. 8, 2016

Related U.S. Application Data

(60) Provisional application No. 61/946,535, filed on Feb. 28, 2014.

(51) Int. Cl.

| | |
|---|---|
| ***B01F 7/00*** | (2006.01) |
| ***B01F 13/00*** | (2006.01) |
| ***B01F 15/00*** | (2006.01) |
| ***E21B 49/08*** | (2006.01) |
| ***B65D 25/14*** | (2006.01) |

(52) U.S. Cl.
CPC ..... *B01F 7/00041* (2013.01); *B01F 13/0052* (2013.01); *B01F 13/0055* (2013.01); *B01F 15/00837* (2013.01); *B01F 15/00844* (2013.01); *B65D 25/14* (2013.01); *E21B 49/086* (2013.01)

(58) Field of Classification Search
CPC ..... B01F 13/0052; B01F 7/00041; B01F 13/0055; B01F 15/00837; B01F 15/00844; E21B 49/086; B65D 25/14
See application file for complete search history.

(56) References Cited

U.S. PATENT DOCUMENTS 2,817,562 A * 12/1957 Fleming ..... F02F 3/10 29/888.048
5,628,901 A 5/1997 Lawrence et al.
2005/0002270 A1 1/2005 Bergman
(Continued)

FOREIGN PATENT DOCUMENTS

JP 09-028764 A 2/1997

OTHER PUBLICATIONS

International Search Report and The Written Opinion of the International Search Authority, or the Declaration, dated Nov. 28, 2014, PCT/US2014/031703, 9 pages, ISA/KR.

*Primary Examiner* — Anshu Bhatia
(74) *Attorney, Agent, or Firm* — Haynes and Boone, LLP

(57) ABSTRACT

A storage container for hydrocarbon fluid includes a mixing device having a sacrificial coating to protect against abrasion of the protective coating along the container wall during mixing.

29 Claims, 2 Drawing Sheets

(56) References Cited

U.S. PATENT DOCUMENTS

2010/0163438 A1 7/2010 Shim
2012/0273203 A1* 11/2012 Lawrence ..... E21B 49/088
166/305.1

* cited by examiner

COATED MIXING DEVICE FOR HYDROCARBON FLUID STORAGE CONTAINERS TO COMBAT MIXING ABRASION

PRIORITY

The present application is a U.S. National Stage patent application of International Application No. PCT/US2014/031703, filed on Mar. 25, 2014, which claims priority to U.S. Provisional Patent Application No. 61/946,535 entitled, "COATED MIXING DEVICE FOR HYDROCARBON FLUID STORAGE CONTAINERS TO COMBAT MIXING ABRASION," filed Feb. 28, 2014, naming Cyrus Irani and Scott Miller as inventors, the disclosures of which are hereby incorporated by reference in their entirety.

FIELD OF THE DISCLOSURE

The present disclosure relates generally to storage containers and, more specifically, to hydrocarbon fluid storage containers having coated mixing devices that prevent abrasion of protective coatings along the container walls during mixing.

BACKGROUND

The oil and gas industry uses a number of collection and storage containers for its sampling and related activities. For example, a certain type of container in which the sample is allowed to flash two phase is used to collect surface liquid and gas samples, usually at a separator, but also at other locations such as downstream of a choke or at a wellhead. In specific instances where a single phase bottom hole sample has been collected against nitrogen for pressure maintenance, the long term storage container it will be transferred into will also be a single phase bottle with a nitrogen charge fir pressure maintenance. In all these cases, the working space of the storage containers, i.e. where the sample resides, will have some sort of mixing device to assure that a homogeneous sample is moved out of the container when needed. The mixing devices, for example, may be spheres of different sizes which will roll back and forth when the storage container is rocked to deliver the necessary mixing action. The mixing device can also be a vortex ring which is a circular ring with an internal cone so designed that the entire ring will slide back and forth in the storage container when rocked to give the desired mixing action.

An issue that has recently surfaced associated with capture and storage containers has been hydrogen sulfide ("$H_2S$") adsorption. After sample capture, the stainless steel container will adsorb low levels of $H_2S$ from the sample, and a subsequent analysis of the sample will give a misleading reading of the $H_2S$ content due to adsorption loss. $H_2S$ is a hazardous chemical, and it is imperative that an accurate accounting of its concentration be undertaken. This is especially significant when designing surface facilities to handle the produced reservoir fluids.

To this end, storage containers are coated with some protective layer of material that offers an impermeable barrier to $H_2S$ adsorption. Two commonly used coatings are silicon and ceramic-based. These coatings are usually laid down in extremely fine thicknesses of 1 micron or less, and as such are susceptible to abrasion. As the mixing device moves within the storage container during mixing, however, the resulting friction causes abrasions along the protective coating due to the metal-to-metal contact of the mixing device and container wall. As a result, $H_2S$ adsorption may occur, thus resulting in erroneous WS concentration measurements.

Accordingly, there is a need in the art for less abrasive mixing devices to address the short-comings of the prior art.

DESCRIPTION OF ILLUSTRATIVE EMBODIMENTS

Illustrative embodiments and related methods of the present disclosure are described below as they might be employed in various mixing devices for hydrocarbon fluid storage containers. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

As described herein, illustrative embodiments of the present disclosure provide a sacrificial coating over the mixing device to thereby prevent abrasion of the protective coating along the storage container wall. To minimize this abrasion and prolong the life of the protective coating, the mixing devices are coated with a material that is sacrificially abraded during mixing relative to the protective coating of the container wall. For example, in one embodiment, the mixing devices are coated with polyether ether ketone ("PEEK"), Teflon®, or similar polymeric material which will suffer abrasion during the mixing action in preference to the protective coating. In one embodiment where the mixing device is spherical, one or more portions of the spherical element are coated. In another embodiment, the mixing element may be a ring-type element (e.g., vortex ring) in which only the edges or one or more portions of the mixing device that comes into direct contact with the protective coating of the container need to be isolated. In other examples, the entire ring may be coated with the sacrificial coating.

Figure 1:
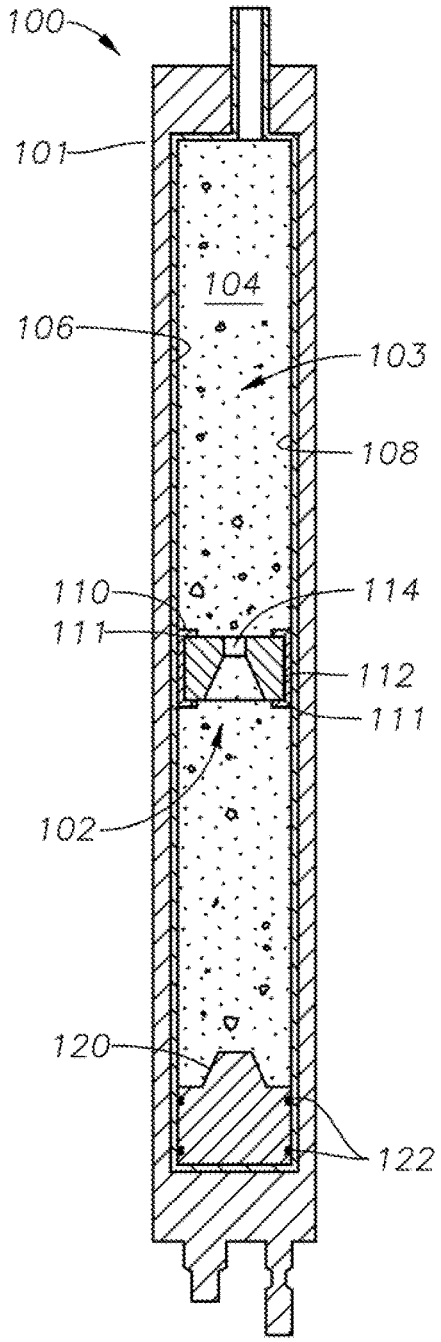
FIG. 1 illustrates a storage container having a coated ring-type mixing device, according to certain illustrative embodiments of the present disclosure.

The specific type of sacrificial coating may take a variety of forms. For example, the sacrificial coating may be narrow bands of elastomeric material positioned around the mixing device and dimensioned to prevent metal-to-metal contact at the high points by appropriate juxtapositioning of the elastomeric barrier. The sacrificial coating may also be an actual coating, applied to the surface of the mixing device. In another, the sacrificial coating may be a total covering of the exterior surface of the mixing device, while in others only a portion of the exterior surface may be coated. Nevertheless, the sacrificial coating could, again, be any of a number of materials including PEEK or Teflon, or even an "O" ring, as shown in FIG. 1. In such embodiments, the only requirement being that the mixing element, be able to move smoothly in the sample working space without any metal-to-metal contact.

FIG. 1 illustrates a storage container having a coated ring-type mixing device, according to certain illustrative embodiments of the present disclosure. Container 100 includes a body 101 having appropriate connections at the upper and lower ends, as understood in the art. Container 100 may be a variety of storage containers, such as, for example, the Xtra™ sample bottle offered by The IKM Group of Norway. Container 100 further includes a mixing device 102 positioned inside working space 104 where hydrocarbon fluid 103 is stored. The interior walls 106 of working space 104 have been coated with a protective coating 108 to protect against a variety of harmful phenomena, such as for example, $H_2S$ adsorption. As previously described, protective coating 108 is laid down in extremely fine thicknesses such as, for example, 1 micron or less, and may be comprised of a variety of materials (ceramic, silicon, etc.). As a result, protective coating 108 is susceptible to abrasion.

To combat abrasion, illustrative embodiments of the present disclosure provide mixing devices coated with a sacrificial coating. In this embodiment, mixing device 102 is a vortex ring which slidingly moves along working space 104 during mixing. In alternative embodiments, however, the ring-type element may be a continuous V-shaped ring, akin to a spring. Nevertheless, vortex ring 102 has a sacrificial coating 110 positioned around it which, in this example, is an applied coating of suitable material (e.g., PEEK or Teflon). In this example, the entire side surface 112 of vortex ring 102 is coated with sacrificial coating 110. In addition, sacrificial coating extends over the edges 111 of vortex ring 102 to further protect against abrasion of protective coating 108. In other embodiments, however, sacrificial coating 110 may be, for example, an O-ring element or coating.

During operation of container 100, working space 104 is filled with sample 103 which results in piston 120 being moved to the end of working space 104. Piston 120 has one or more seals 122 positioned around its side surface. When it is desired to mix sample 103, container 100 is agitated which results in movement of vortex ring 102 up and down along working space 104. As vortex ring moves, sample 103 is mixed because of the agitation caused as sample 103 moves through bore 114. Also during mixing, sacrificial coating 110 slides up and down interior walls 106, thereby preventing any metal-to-metal contact between mixing device 102 and walls 106. As a result, protective coating 108 is not abraded. Also note that, in sortie instances, sacrificial coating 110 may itself become damaged and need replacement, thus it is referred to as a "sacrificial" coating.

Figure 2:
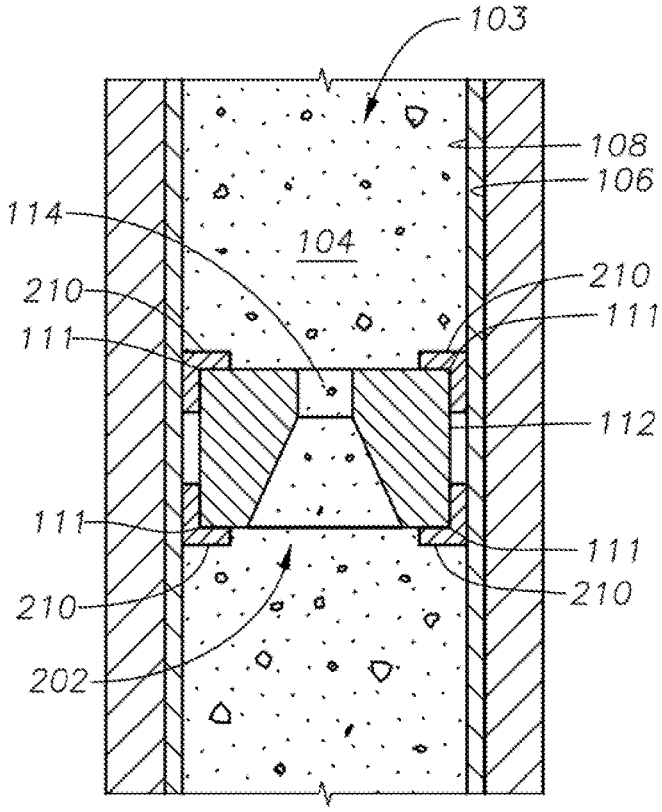
FIGS. 2 and 3 are exploded views of mixing device, according to alternative embodiments of the present disclosure.

FIG. 2 is an exploded view of a mixing device positioned inside a container, according to an alternative embodiment of the present disclosure. Mixing device 202 is somewhat similar to mixing device 102 described with reference to FIG. 1 and, therefore, may be best understood with reference thereto, where like numerals indicate like elements. In contrast, however, mixing device 202 comprises sacrificial coating 210 along its edges 111, with portions that extend beyond edges 111 to provide abrasion protection to protective coating 108.

Figure 3:
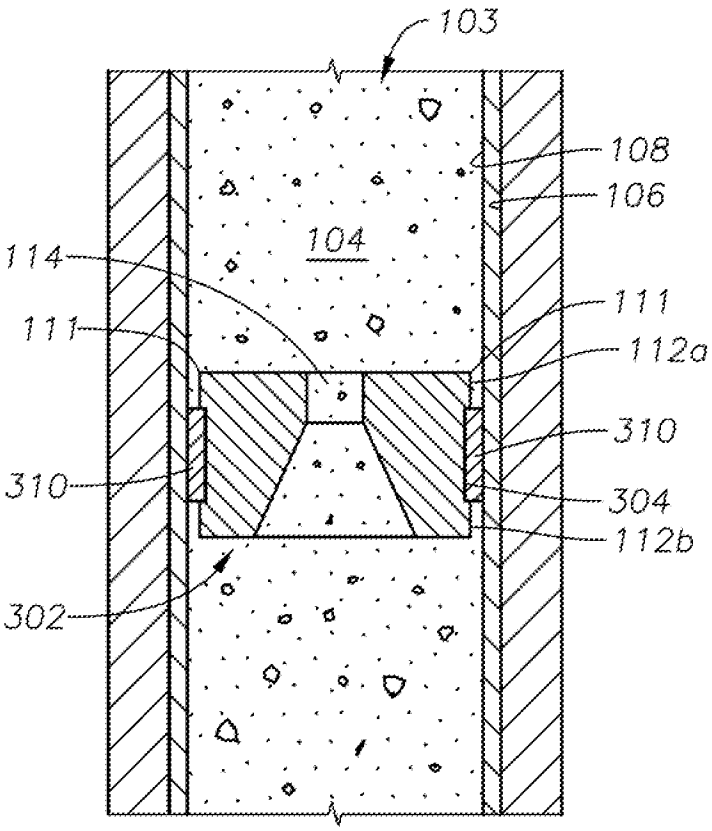

FIG. 3 is an exploded view of a mixing device positioned inside a container, according to yet another alternative, embodiment of the present disclosure. Mixing device 302 is somewhat similar to mixing device 102 described with reference to FIG. 1 and, therefore, may be best understood with reference thereto, where like numerals indicate like elements. In contrast, however, mixing device 302 comprises an annular groove 304 in which a sacrificial coating 310 is positioned. In this embodiment, sacrificial coating 310 may be a PEEK ring which snaps into place, or some other suitable coating material. During mixing, sacrificial coating 310 slides up and down interior walls 106, thereby preventing ring side surface sections 112*a,b* from touching walls 106. As a result, protective coating 108 is not abraded.

Figure 4:
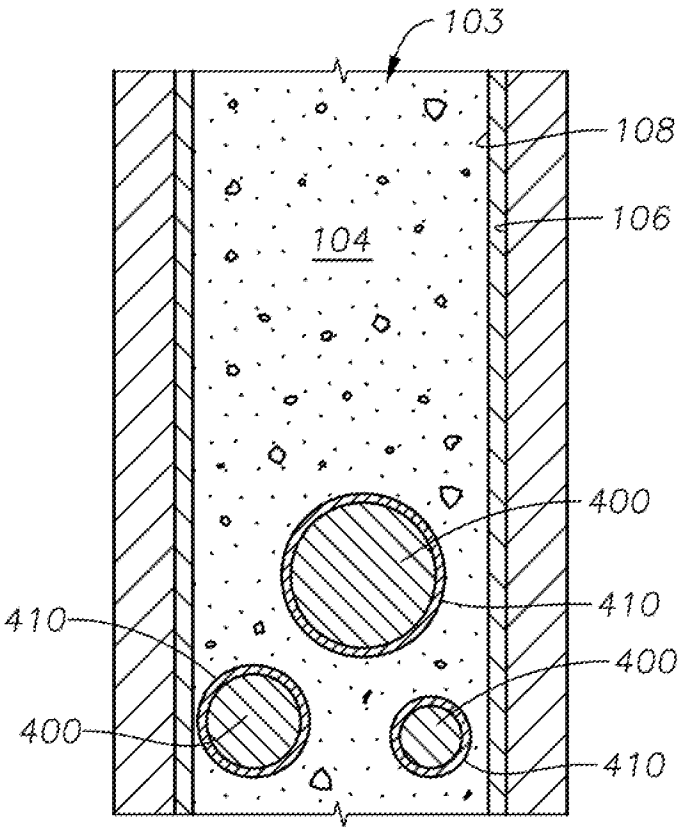
FIG. 4 illustrates a storage container having a coated spherical element-type mixing device, according to certain illustrative embodiments of the present disclosure.

FIG. 4 illustrates an alternate embodiment whereby the mixing device is one or more spherical elements 400. As shown, in this example, spherical elements 400 are different sizes. Each is coated with a sacrificial coating 410. Spherical elements 400 may be comprised of ceramic, metal, plastic or some other suitable material. In certain embodiments, the entire surface of spherical elements 400 may be coated, while in others only a portion of the surface may be coated (e.g., a hash-like "#" design). Although spherical elements 400 are shown as solid metal elements, in other embodiments they may be hollow or even take a wiffle ball-like design. Nevertheless, during mixing, as spherical elements 400 move along working space 104, sacrificial coating 410 prevents abrasion of protective coating 108.

Embodiments described herein further relate to any one or more of the following paragraphs:

1. A storage container to store hydrocarbon fluid, the storage container comprising a working space in which hydrocarbon fluid is stored, the working space having a protective coating; and a mixing device positioned inside the working space, the mixing device having a sacrificial coating that engages the protective coating.

2. A storage container as defined in paragraph 1, wherein the mixing device is a spherical element.

3. A storage container as defined in paragraphs 1 or 2, wherein the mixing device is a plurality spherical elements having different sizes.

4. A storage container as defined in any of paragraphs 1-3, wherein the mixing device is a ring-type element.

5. A storage container as defined in any of paragraphs 1-4, wherein the ring-type element is a vortex ring comprising a top surface; a bottom surface; and a side surface that engages the protective coating, wherein the sacrificial coating is positioned along edges of the vortex ring.

6. A storage container as defined in any of paragraphs 1-5, wherein the ring-type element is a vortex ring comprising a top surface; a bottom surface; a side surface that engages the protective coating, and an annular groove positioned along the side surface, wherein the sacrificial coating is positioned inside the annular groove.

7. A storage container as defined in any of paragraphs 1-6, wherein the protective coating is impermeable to H2S adsorption; and the sacrificial coating is a polymer.

8. A storage container as defined in any of paragraphs 1-7, wherein the polymer is polyether ether ketone ("PEEK") or Teflon.

9. A method for storing a hydrocarbon fluid, comprising placing hydrocarbon fluid in a working space of a storage container, the working space having an protective coating; mixing the hydrocarbon fluid using a mixing device positioned inside the working, space; and preventing abrasion of the protective coating by the mixing device.

10. A method as defined in paragraph 9, wherein a sacrificial coating positioned around the mixing device is utilized to prevent abrasion of the protective coating.

11. A method as defined in paragraphs 9 or 10, wherein a spherical element is utilized as the mixing device.

12. A method as defined in any of paragraphs 9-11, wherein a ring-type element is utilized as the mixing device.

13. A method as defined in any of paragraphs 9-12, further comprising preventing adsorption of H2S using the protective coating.

14. A method for manufacturing a storage container to store hydrocarbon fluid, the method comprising providing a working space in which hydrocarbon fluid is stored, the working space having a protective coating; and providing a mixing device positioned inside the working space, the mixing device having a sacrificial coating that engages the protective coating.

15. A method as defined in paragraph 14, wherein the mixing device is provided, as a spherical element.

16. A method as defined in paragraphs 14 or 15, wherein the mixing device is provided as a plurality of spherical elements having different sizes.

17. A method as defined in any of paragraphs 14-16, wherein the mixing device is provided as a ring-type element.

18. A method as defined in any of paragraphs 14-17, wherein the ring-type element is provided as a vortex ring comprising a top surface; a bottom surface; and a side surface that engages the protective coating, wherein the sacrificial coating is positioned along edges of the vortex ring.

19. A method as defined in any of paragraphs 14-18, wherein: the protective coating is provided as a coating, impermeable to H2S adsorption; and the sacrificial coating is provided as a polymer.

20. A method as defined in any of paragraphs 14-19, wherein the polymer is provided as polyether ether ketone ("PEEK") or Teflon.

Although various embodiments and methodologies have been shown and described, the disclosure is not limited to such embodiments and methodologies, and will be understood to include all modifications and variations as would be apparent to one ordinarily skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A storage container to store hydrocarbon fluid, the storage container comprising:

a working space in which hydrocarbon fluid is stored, the working space having a protective coating; and a mixing device positioned inside the working space, the mixing device having a sacrificial coating that engages the protective coating, wherein the mixing device is a sphere.

2. A storage container as defined in claim 1, wherein the mixing device is a plurality of spheres having different sizes.

3. A storage container as defined in claim 1, wherein:

the protective coating is impermeable to $H_2S$ adsorption; and the sacrificial coating is a polymer.

4. A storage container as defined in claim 3, wherein the polymer is polyether ether ketone ("PEEK") or Teflon.

5. A method for storing a hydrocarbon fluid, comprising:

placing hydrocarbon fluid in a working space of a storage container, the working space having an protective coating;

mixing the hydrocarbon fluid using a mixing device positioned inside the working space, the mixing device being a sphere having a sacrificial coating thereon that engages the protective coating; and preventing abrasion of the protective coating by the mixing device.

6. A method as defined in claim 5, wherein a plurality of spheres are utilized as the mixing device.

7. A method as defined in claim 6, wherein the spheres are different sizes.

8. A method as defined in claim 5, further comprising preventing adsorption of $H_2S$ using the protective coating.

9. A method for manufacturing a storage container to store hydrocarbon fluid, the method comprising:

providing a working space in which hydrocarbon fluid is stored, the working space having a protective coating; and providing a mixing device positioned inside the working space, the mixing device being a sphere having a sacrificial coating thereon that engages the protective coating.

10. A method as defined in claim 9, wherein the mixing device is provided as a plurality of spheres.

11. A method as defined in claim 10, wherein the spheres are different sizes.

12. A method as defined in claim 9, wherein:

the protective coating is provided as a coating impermeable to $H_2S$ adsorption; and the sacrificial coating is provided as a polymer.

13. A method as defined in claim 12, wherein the polymer is provided as polyether ether ketone ("PEEK") or Teflon.

14. A storage container to store hydrocarbon fluid, the storage container comprising:

a working space in which hydrocarbon fluid is stored, the working space having a protective coating; and a mixing device positioned inside the working space, the mixing device having a sacrificial coating that engages the protective coating, wherein the mixing device is a vortex ring comprising:

a top surface;

a bottom surface; and a side surface, wherein the sacrificial coating is positioned along edges of the vortex ring, the sacrificial coating comprising:

a first coating extending over a portion of the top surface and a portion of the side surface; and a second coating extending over a portion of the bottom surface and a portion of the side surface.

15. A storage container as defined in claim 14, wherein:

the protective coating is impermeable to $H_2S$ adsorption; and the sacrificial coating is a polymer.

16. A storage container as defined in claim 15, wherein the polymer is polyether ether ketone ("PEEK") or Teflon.

17. A storage container to store hydrocarbon fluid, the storage container comprising:

a working space in which hydrocarbon fluid is stored, the working space having a protective coating; and a mixing device positioned inside the working space, the mixing device having a sacrificial coating that engages the protective coating, wherein the mixing device is a vortex ring comprising:

a top surface;

a bottom surface;

a side surface; and an annular groove positioned along the side surface, wherein the sacrificial coating is positioned inside the annular groove and extends out beyond the side surface to engage the protective coating such that the side surface does not engage the protective coating.

18. A storage container as defined in claim 17, wherein:

the protective coating is impermeable to $H_2S$ adsorption; and the sacrificial coating is a polymer.

19. A storage container as defined in claim 18, wherein the polymer is polyether ether ketone ("PEEK") or Teflon.

20. A method for storing a hydrocarbon fluid, comprising:

placing hydrocarbon fluid in a working space of a storage container, the working space having a protective coating;

mixing the hydrocarbon fluid using a mixing device positioned inside the working space, the mixing device having a sacrificial coating that engages the protective coating, wherein the mixing device is a vortex ring comprising:

a top surface;

a bottom surface; and a side surface, wherein the sacrificial coating is positioned along edges of the vortex ring, the sacrificial coating comprising:

a first coating extending over a portion of the top surface and a portion of the side surface;

and a second coating extending over a portion of the bottom surface and a portion of the side surface; and preventing abrasion of the protective coating by the mixing device.

21. A method as defined in claim 20, further comprising preventing adsorption of H2S using the protective coating.

22. A method for manufacturing a storage container to store hydrocarbon fluid, the method comprising:

providing a working space in which hydrocarbon fluid is stored, the working space having a protective coating; and providing a mixing device positioned inside the working space, the mixing device having a sacrificial coating that engages the protective coating, wherein the mixing device is a vortex ring comprising:

a top surface;

a bottom surface; and a side surface, wherein the sacrificial coating is positioned along edges of the vortex ring, the sacrificial coating comprising:

a first coating extending over a portion of the top surface and a portion of the side surface; and a second coating extending over a portion of the bottom surface and a portion of the side surface.

23. A method as defined in claim 22, wherein:

the protective coating is provided as a coating impermeable to H2S adsorption; and the sacrificial coating is provided as a polymer.

24. A method as defined in claim 22, wherein the polymer is provided as polyether ether ketone ("PEEK") or Teflon.

25. A method for storing a hydrocarbon fluid, comprising:

placing hydrocarbon fluid in a working space of a storage container, the working space having a protective coating;

mixing the hydrocarbon fluid using a mixing device positioned inside the working space, the mixing device having a sacrificial coating that engages the protective coating, wherein the mixing device is a vortex ring comprising:

a top surface;

a bottom surface;

a side surface; and an annular groove positioned along the side surface, wherein the sacrificial coating is positioned inside the annular groove and extends out beyond the side surface to engage the protective coating such that the side surface does not engage the protective coating; and preventing abrasion of the protective coating by the mixing device.

26. A method as defined in claim 25, further comprising preventing adsorption of H2S using the protective coating.

27. A method for manufacturing a storage container to store hydrocarbon fluid, the method comprising:

providing a working space in which hydrocarbon fluid is stored, the working space having a protective coating; and providing a mixing device positioned inside the working space, the mixing device having a sacrificial coating that engages the protective coating, wherein the mixing device a vortex ring comprising: a top surface;

a bottom surface; a side surface; and an annular groove positioned along the side surface, wherein the sacrificial coating is positioned inside the annular groove and extends out beyond the side surface to engage the protective coating such that the side surface does not engage the protective coating.

28. A method as defined in claim 27, wherein:

the protective coating is provided as a coating impermeable to H2S adsorption; and the sacrificial coating is provided as a polymer.

29. A method as defined in claim 27, wherein the polymer is provided as polyether ether ketone ("PEEK") or Teflon.

* * * * *